US006058897A

United States Patent [19]

Nakayoshi

[11] Patent Number: 6,058,897

[45] Date of Patent: May 9, 2000

[54] VALVE TIMING DEVICE

[75] Inventor: Hideki Nakayoshi, Kariya, Japan

[73] Assignee: Aisin Seiki Kabushiki Kaisha, Aichi-pref, Japan

[21] Appl. No.: 09/281,981

[22] Filed: Mar. 31, 1999

[30] Foreign Application Priority Data

Mar. 31, 1998 [JP] Japan ..... 10-085944

[51] Int. Cl.[7] ..... F01L 1/344; F01L 13/00

[52] U.S. Cl. ..... 123/90.17; 123/90.31

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 5,738,056 | 4/1998 | Mikame et al. | 123/90.17 |
| 5,823,152 | 10/1998 | Ushida | 123/90.17 |
| 5,845,615 | 12/1998 | Nakamura et al. | 123/90.17 |
| 5,901,674 | 5/1999 | Fujiwaki | 123/90.17 |
| 5,924,395 | 7/1999 | Moriya et al. | 123/90.15 |

FOREIGN PATENT DOCUMENTS 1-92504 4/1989 Japan .

9-250310 9/1997 Japan .

*Primary Examiner*—Weilun Lo

*Attorney, Agent, or Firm*—Reed Smith Hazel & Thomas LLP

[57] ABSTRACT

A valve timing control device comprises: a rotary shaft rotatably assembled within a cylinder head of an internal combustion engine; a rotational transmitting member mounted around the peripheral surface of the rotary shaft so as to rotate relative thereto within a predetermined range for transmitting a rotational power from a crank shaft; a vane provided on either one of the rotary shaft and the rotational transmitting member; a pressure chamber formed between the rotary shaft and the rotational transmitting member, and divided into an advance chamber and a delay chamber by the vane; a first fluid passage for supplying and discharging a fluid to and from the advance chamber; a second fluid passage for supplying and discharging a fluid to and from the delay chamber; a locking mechanism for holding the vane in the middle position of the pressure chamber, when the internal combustion engine starts; and a control mechanism for restricting the rotational transmitting member to rotate around the rotary shaft, when the vane is the middle position and a pressure of either one of the advancing chamber and the delaying chamber is less than a predetermined pressure.

6 Claims, 3 Drawing Sheets

VALVE TIMING DEVICE

FIELD OF THE INVENTION

The present invention relates to a valve timing control device and, in particular, to the valve timing control device for controlling an angular phase difference between a crank shaft of a combustion engine and a cam shaft of the combustion engine.

BACKGROUND OF THE INVENTION

A conventional valve timing control device comprises: a rotational shaft for opening and closing a valve; a rotational transmitting member rotatably mounted on the rotational shaft; a vane provided on the rotational shaft; a pressure chamber formed between the rotational shaft and the rotational transmitting member and divided into an advance chamber and a delay chamber by the vane; a first fluid passage communicated with the advance chamber for supplying and discharging a fluid; a second fluid passage communicated with the delay chamber for supplying and discharging the fluid; and a locking member for maintaining a relative position between the rotational shaft and the rotational transmitting member. Such a conventional variable timing device is disclosed, for example, in Japanese Laid-Open Publication No. H 01-92504 and in Japanese Laid-Open Publication No. H09-250310.

In the conventional valve timing control device, the valve timing is advanced due to relative displacement between the rotational shaft and the rotational transmitting member when the fluid is supplied to the advance chamber and is discharged from the delay chamber. On the contrary, the valve timing is delayed due to the counter displacement between the rotational shaft and the rotational transmitting member when the fluid is discharged from the advance chamber and is supplied to the delay chamber.

Further, in the conventional valve timing control device disclosed in the publications, the vane transmits the rotation from the rotational transmitting member to the rotational shaft. Therefore, the rotational shaft always receives a force to expand the delay chamber while the internal combustion engine is running. When the internal combustion engine is stalled, the rotational shaft rotates so as to expand the delay chamber due to lack of enough fluid supply to hold the vane at the current position. Thus, the rotational shaft reaches to the most delayed position where the delay chamber is the largest. In case tile internal combustion engine is restarted at the most delayed position of the rotational shaft, the vane vibrates due to unstable transitional pressure so as to generate undesirable noise. Conventionally, the locking member maintains the predetermined relative position between the rotational shaft and the rotational transmitting member so that such vibration of the vane is effectively prevented from generating.

By the way, air intake tries to flow into a cylinder by inertia even after the piston begins to go to the top dead center while the internal combustion engine is running at high speed. Therefore, volumetric efficiency may be improved by delaying closure of an air-intake valve so that the output of the internal combustion engine may be improved.

However, in the conventional valve timing control device, the most delayed timing has to be set so that the air intake is sufficient to start the internal combustion engine. This means that the closing timing of the air-intake valve is not optimized for the high-speed operation of the internal combustion engine. Thus, the volumetric efficiency cannot be improved by the inertia of the air intake. If the closing timing of the air intake valve is unreasonably optimized for the high speed operation of the internal combustion engine, the air intake which is once inhaled into the cylinder flows backward upon start of the internal combustion engine since the air intake does not have enough inertia and the air-intake valve continues to be opened even after the piston passes the bottom dead center and begins to go to the top dead center. Therefore, the internal combustion engine becomes hard to start due to insufficient compression ratio and imperfect combustion. Further, in the conventional valve timing control device, due to low atmospheric pressure, the similar disadvantage may be expected at altitudes if the air intake valve is set to be closed at around the bottom dead center of the piston.

Further, in the conventional valve timing control device, if the exhaust valve timing is delayed similarly, an amount of exhaust gas recirculation is increased by an extended overlapping time of the air-intake valve and the exhaust valve so that the internal combustion engine becomes hard to start.

SUMMARY OF THE INVENTION

The invention has been conceived to solve the above-specified problems. According to the invention, there is provided a valve timing control device which comprises: a rotary shaft rotatably assembled within a cylinder head of an internal combustion engine; a rotational transmitting member mounted around the peripheral surface of the rotary-shaft so as to rotate relative thereto within a predetermined range for transmitting a rotational power from a crank shaft; a vane provided on either one of the rotary shaft and the rotational transmitting member; a pressure chamber formed between the rotary shaft and the rotational transmitting member, and divided into an advance chamber and a delay chamber by the vane; a first fluid passage for supplying and discharging a fluid to andfrom the advance chamber; a second fluid passage for supplying and discharging a fluid to and from the delay chamber; a locking mechanism for holding the vane in the middle position of the pressure chamber, when the internal combustion engine starts; and a control mechanism for restricting the rotational transmitting member to rotate around the rotary shaft, when the vane is the middle position and a pressure of either one of the advance chamber and the delay chamber is less than a predetermined pressure.

Other objects and advantages of invention will become apparent during the following discussion of the accompanying drawings.

BRIEF DESCRIPTION OF THE DRAWING FIGURES

The foregoing and additional features of the present invention will become more apparent from the following detailed description of an embodiment thereof when considered with reference to the attached drawings, in which.

DETAILED DESCRIPTION OF THE PREFERRED EMBODIMENTS

A valve timing control device in accordance with a preferred embodiment of the present invention will be described with reference to the attached drawings.

Figure 1:
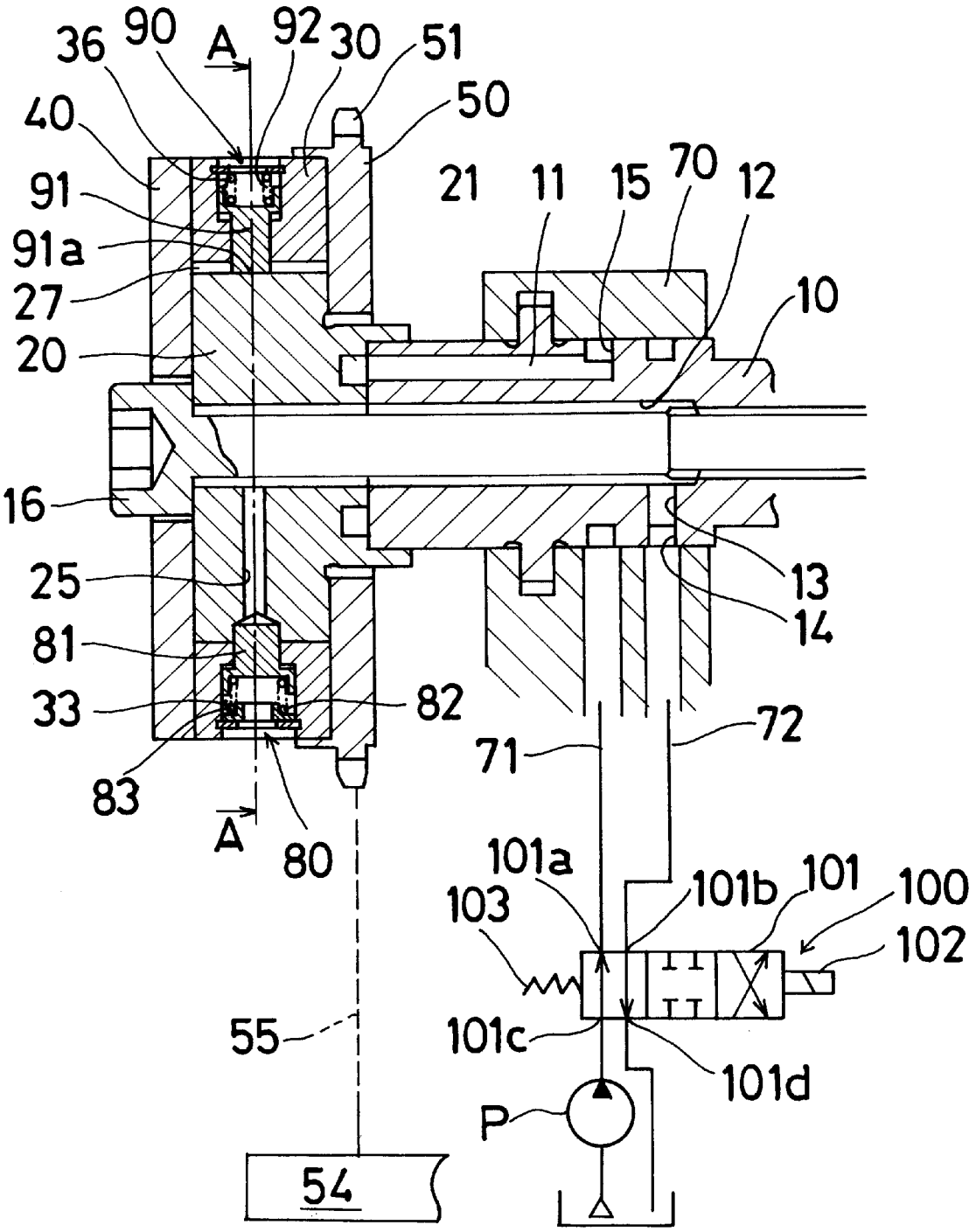
FIG. 1 is a sectional view of the embodiment of a valve timing control device in accordance with the prevent invention.
Figure 2:
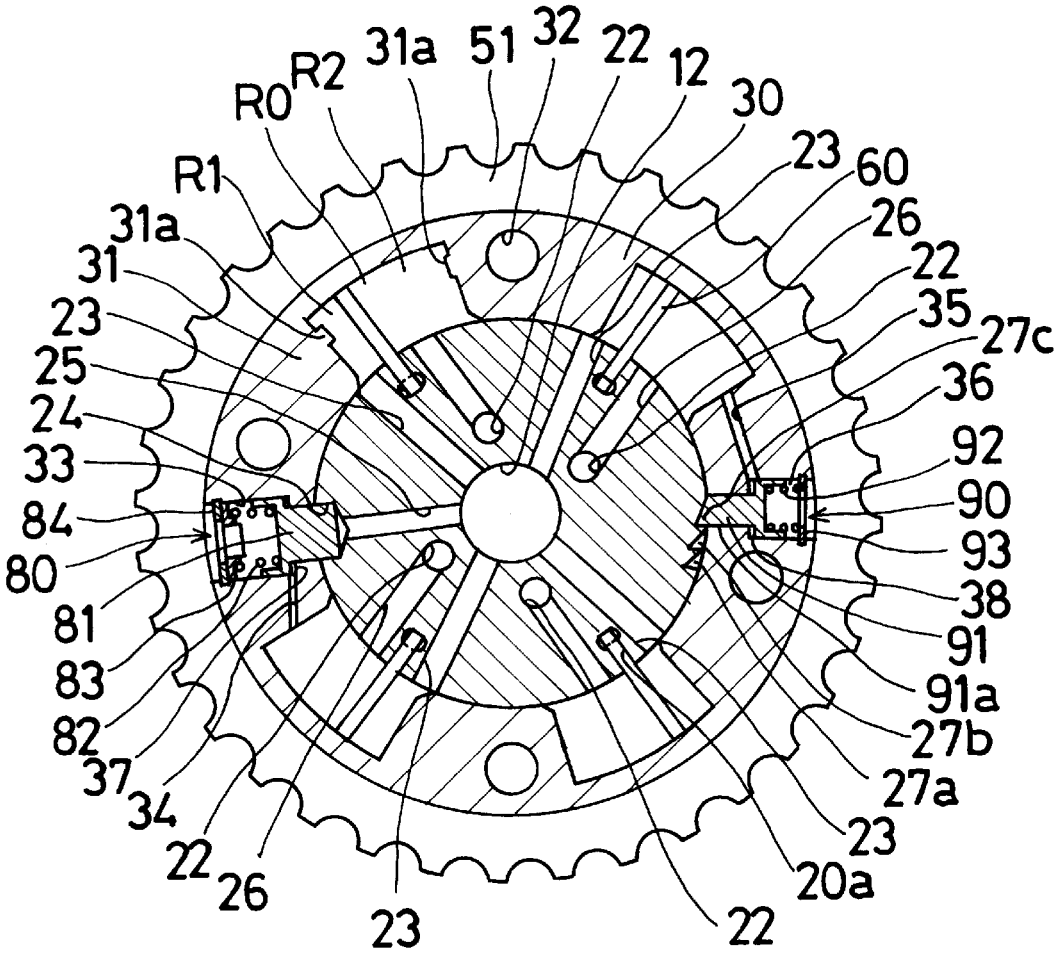
FIG. 2 is a section taken along the line A—A in FIG. 2.
Figure 3:
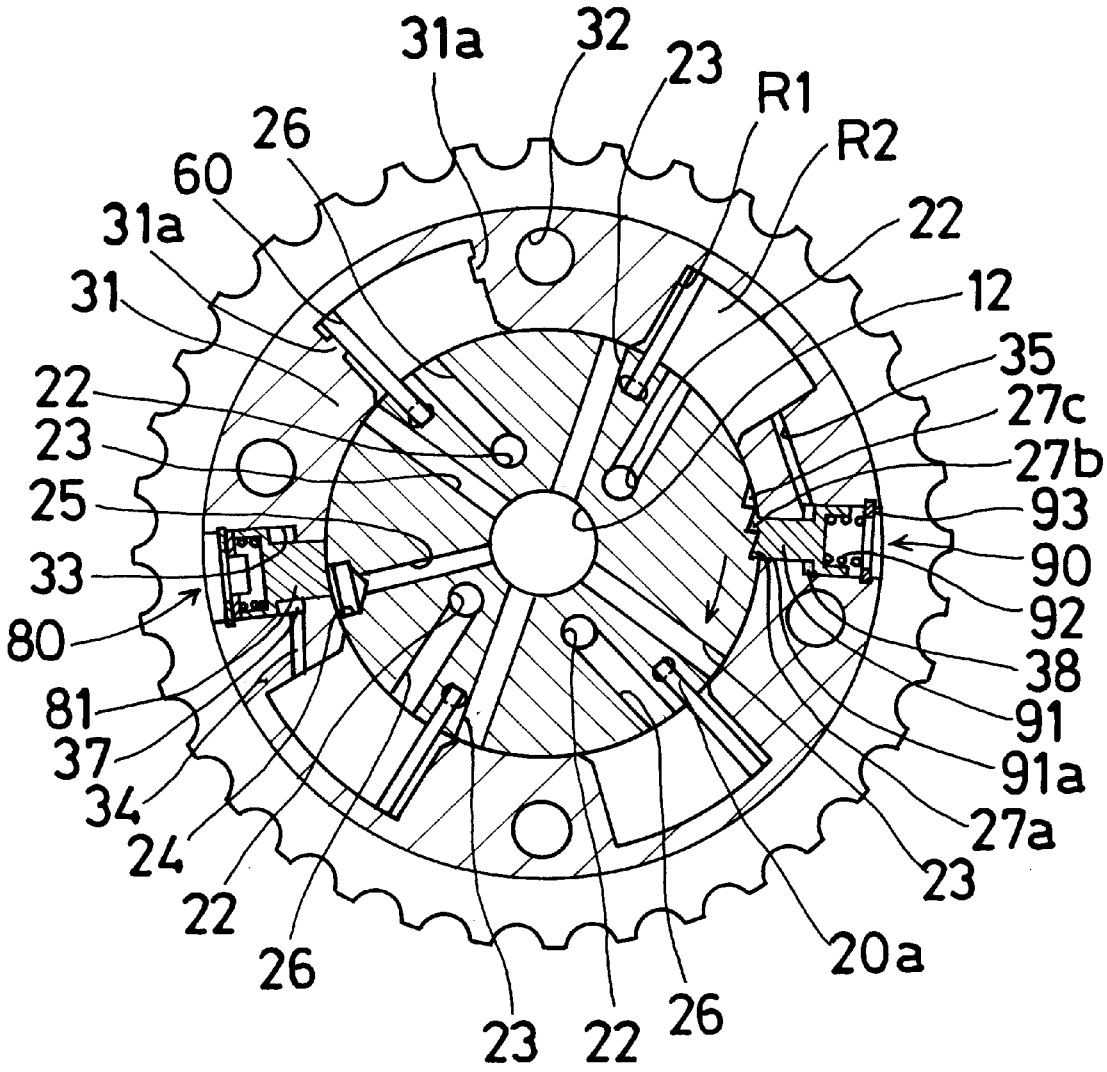
FIG. 3 is a view similar to FIG. 2 but showing the most delayed position.

A valve timing control device according to the present invention as shown in FIGS. 1 to 3, is constructed so as to comprise a valve opening and closing shaft including a cam shaft 10 rotatably supported by a cylinder head 70 of an internal combustion engine, and an internal rotor 20 integrally provided on the leading end portion of the cam shaft 10; a rotational transmitting member mounted around the internal rotor 20 so as to rotate relative thereto within a predetermined range and including an external rotor 30, a front plate 40, a rear plate 50 and a timing sprocket 51 which is integrally formed around the rear plate 50; four vanes 60 assembled with the internal rotor 20; and a locking mechanism 80 assembled with the external rotor 30. Here, the timing sprocket 51 is constructed, as is well known in the art, to transmit the rotating power to the clockwise direction of FIG. 2 from a crankshaft 54 through a timing chain 55.

The cam shaft 10 is equipped with a well-known cam (not shown) for opening and closing an intake valve (not shown) and is provided therein with a delay passage 11 and an advance passage 12, which are extended in the axial direction of the cam shaft 10. The advance passage 12, which is disposed around a bolt 16, is connected to a connection port bib of a control valve 100 via a radial passage 13, an annular passage 14 and a connection passage 72. On the other hand, the delay passage 11 is connected to a connection port 101*a* of the control valve 100 via an annular passage 15 and a connection passage 71.

The control valve 100 includes a solenoid 102, a spool 101 and a sprint 103. In FIG. 1, the solenoid 102 drives the spool 101 leftward against the spring 103 when the solenoid 102 is energized. In the energized state, the control valve 100 connects an inlet port 101*c* to a connection port bib and also connects the connection port 101*a* to a drain port bid. On the contrary, in the normal state, the control valve 100 connects the inlet port 101*c* to the connection port 101*a* and also connects the connection port bib to the drain port 101*d*, as shown in FIG. 1. The solenoid 102 of the control valve 100 is energized by an electronic controller (not shown). As a result, the working oil is supplied to the delay passage 11 when the solenoid 102 is deenergized, and to the advance passage 12 when the same is energized. Because of duty ratio control of the electronic controller, the spool 101 may be linearly controlled so as to be retained at various intermediate positions. All the ports 101*a*, 101*b*, 101*c* and 101*d* are closed while the spool 101 is retained at the intermediate position.

The internal rotor 20 is integrally fixed in the cam shaft 10 by means of the bolt 16 and is provided with four vane grooves 20*a* for providing the four vanes 60 individually in the radial directions. Further provided are a fitting hole 24 for fitting a small diameter portion of the locking pin 81 to a predetermined extent in the state shown in FIG. 2, where the cam shaft 10, the internal rotor 20 and the external rotor 30 are in synchronized phase (the vane 70 is in the middle position of a chamber R0) relative to one another; a passage 25 for supplying and discharging the working oil to and from the fitting hole 24 via the advance passage 12; four passages 23 for supplying and discharging the working oil to and from advancing chambers R1, as defined by the individual vanes 60, via the advance passage 12; a circle groove 21 which is communicated with the delaying passage 11; four connecting passages 22 which are formed in the axis direction of the bolt 16 and each of which is communicated with the circle groove 21; and four passages 26 for supplying and discharging the working oil to and from delaying chambers R2, as defined by the individual vanes 60, via the delaying passage 11, the circle groove 21 and the connecting passage 22. The fitting hole 24 is disposed on the peripheral surface of the internal rotor 20 and is extended in the radial direction of the internal rotor 20. In addition, there are three connecting grooves 27*a* through 27*c* on the peripheral surface of the internal rotor 20. The connecting grooves 27*a* through 27*c* are members of a ratchet mechanism 90. As shown in FIGS. 2 and 3, the connecting grooves 27*a* through 27*c* are continuously arranged in the circuit direction on the peripheral surface of the internal rotor 20. When the locking mechanism 80 prevents the internal rotor 20 from rotating relative to the external rotor 30 as shown in FIG. 2, the connecting groove 27*c* can be inserted into a top portion of a ratchet pin 91. Here, each vane 60 is urged radially outward by a vane spring (not shown) fitted in the bottom portion of the vane groove 20*a*.

The external rotor 30 is so assembled with the outer circumference 20 of the internal rotor 20 so as to rotate relative thereto with a predetermined range. To the two sides of the external rotor 30, there are joined the front plate 40 and the rear plate 50 by means of four bolts (not shown), each of which goes through a penetrating passage 32 of the external rotor 30. Further, four radial projections 31 are formed inwardly in the external rotor 30. Tops of the radial projections 31 are touched with the internal rotor 20 so that the external rotor 30 rotates around the internal rotor 20. The lock pin 81 and a spring 82 are contained in a stepped bore 33 that is formed in one of the radial projections 31. The stepped bore 33 extends in a radial direction of the external rotor 30. In addition, there is another stepped bore 36 that is formed in another of the radial projections 31. The stepped bore 36 is symmetrically placed about the axis of the internal rotor 20. The stepped bore 36 contains the ratchet pin 91 and a spring 92. The stepped bore 36 also extends in radial direction of the external rotor 30.

Each vane 60 has a rounded edge that touches with the external rotor 30 in fluid tight manner. Each vane 60 also touches with both the plates 40 and 50 in fluid tight manner. The vanes 60 may slide in the vane grooves 20*a* in a radial direction of the internal rotor 20. Each vane 60 divides each of the pressure chambers R0 into the advance chamber R1 and the delay chamber R2. The pressure chambers R0 are formed by the external rotor 30, the radial projections 31, the internal rotor 20, the front plate 40 and the rear plate 50. As shown in FIGS. 2 and 3, in order to limit the relative rotation between the internal rotor 20 and the external rotor 30 within a predetermined range, one of the vanes 60 (a vane 60*a* which is described at upper left in FIG. 2) touches with the adjacent radial projections 31*a* at the most advanced and delayed positions. In other words, as shown in FIG. 3, the most delayed position is achieved when the upper left vane 60*a* touches with a delayed side of the radial projection 31*a* due to the expanded delay chambers R2.

The lock pin 81 comprises the small diameter portion and a large diameter portion. The lock pin 81 is slidably inserted in the stepped bore 33. The lock pin 81 is pushed toward the internal rotor 20 by the spring 82. The spring 82 is inserted between the lock pin 81 and a retainer 83. The retainer 83 is held in the stepped bore 33 by a snap ring 84. A ring dent is formed on a step between the small diameter portion and the large diameter portion. The ring dent forms a ring space 37 when the small diameter portion is projected in the fitting hole 24 as shown in FIG. 2. The ring space 37 communicates with the adjacent delay chamber R2 through a communication passage 34 formed in the radial projection 31.

The ratchet pin 91 comprise a small diameter portion and a large diameter portion. The ratchet pin 91 is slidably inserted in the stepped bore 36. The ratchet pin 91 is pushed toward the internal rotor 20 by a spring 92. The spring 92 is inserted between the ratchet pin 91 and a retainer 93. A connecting portion 91*a* is formed on a top portion of the small diameter portion of the ratchet pill 91. The connecting portion 91*a* can engage with the contacting grooves 27*a* through 27*c*. The connecting portion 91*a* forms an inclination surface such that the length of the delay side of the small diameter portion of the ratchet pin 91 is shorter than the length of the advance side of the same. On the other hand each of the contacting grooves 27*a* through 27*c* includes an inclination surface and a vertical surface. Each inclination surface of the contacting grooves 27*a*though 27*c* is formed along the inclination surface of the connecting portion 91*a* of the ratchet pin 91. Each of the vertical surfaces of the contacting grooves 27*a*though 27*c* is formed along a side wall which is formed on the advance side of the small diameter portion of the ratchet pin 91 so as to contact the side wall of the advance side of the same. Therefore, when the small diameter portion of the ratchet pin 91 is projected in one of the contacting grooves 27*a* though 27*c*, the side wall of the advance side of the small diameter portion of the ratchet pin 91 is contacted with the vertical surface of one of contacting grooves 27*a* though 27*c* so as to prevent the internal rotor 20 from rotating relative to the external rotor 30 in the delay direction (counter-clockwise direction of FIGS. 2 and 3). On the other hand, in the above state, the internal rotor 20 can rotate relative to the external rotor 30 in the advance direction (clockwise direction of FIGS. 2 and 3), since each inclination surface of the contacting grooves 27*a* though 27*c* can slide on the inclination surface of the connecting portion 91*a* of the ratchet pin 91 in the advance direction such that the vertical surfaces of the contacting grooves 27*a* though 27*c* come apart from the side wall of the advance side of the smaller diameter portion of the ratchet pin 91. By the way, the ratchet pin 91 can slide in the stepped bore 36, but can not rotate around the axis itself for the purpose of preventing the ratchet pin 91 from rotating, either one of the small diameter portion or the large diameter portion of the ratchet pin 91 is not made to be a strict circle in cross section, or a projection and a slit that can receive the projection is added between the ratchet pin 91 and the stepped bore 36. The projection is formed on either one of the outer circumference of the ratchet pin 91 or the inner circumference of the stepped bore 36, and extends in the axial direction thereof. The slit is formed on the other one of the inner circumference of the stepped bore 36 or the outer circumference of the ratchet pin 91 so as to receive the projection. In addition, a ring dent is formed on a step between the small diameter portion and the large diameter portion. The ring dent forms a ring space 38 when the small diameter portion is projected in one of the connecting groove 27*a*, 27*b* or 27*c* as shown in FIGS. 2 and 3. The ring space 38 communicates with the adjacent delay chamber R2 through a communication passage 35 formed in the radial projection 31.

In the above embodiment, when each of the vanes 60 is in the middle position of the pressure chamber R0, the outer end of the fitting hole 24 corresponds with the inner end of the stepped bore 33 such that the locking pin 81 is projected in the fitting hole 24. In this state, the valve timing of the intake valve is controlled to be able to start the internal combustion engine. Further, in the above state, the small diameter portion of the ratchet pin 91 is projected into the contacting groove 27*c* as shown in FIG. 2.

In the above embodiment, the sum of pressures in the advance chamber balances with the sum of the pressures in the delay chambers R2 and a rotational counter torque of the pressure chambers R0 results when predetermined fluid pressures are supplied to the advance chamber R1 and the delay chamber R2 after start of the internal combustion engine. When the external rotor 30 is rotated, the rotational counter force is always applied to the vanes 60 toward the most delayed position since the pressure chambers R0 and the vanes 60 are in the torque transmission path between the external rotor 30 and the internal rotor 20. In accordance with various conditions of the internal combustion engine, the control valve 100 is controlled to change the balance. The operational fluid (working oil) is supplied to the advance chambers R1 through the advance passage 12 and passages 23, and is discharged from the delay chambers R2 through the passages 26, the connecting passages 22, the circle groove 21 and the delay passage 11 when the duty ratio is increased to energize the control valve 100 is energized. The internal rotor 20 and the vanes 60 rotate toward the most advanced position (clockwise direction in FIG. 3) relative to the external rotor 30, the front plate 40 and the rear plate 50 when the operational fluid is supplied to the advance chambers R1 and is discharged from the delay chambers R2. The relative rotation of the internal rotor 20 and the vanes 60 is limited by the upper left vane 60*a* and the radial projection 31*a*. Further, the operational fluid is supplied to the delay chambers R2 through the passages 26, the connecting passages 22, the circle groove 21 and the delay fluid passage 11 and is discharged from the advance chambers R1 through the advance passage 12 and passages 23 when the duty ratio is decreased to less energize the control valve 100. The internal rotor 20 and the vanes 60 rotate toward the most delayed position (counterclockwise direction in FIG. 3) relative to the external rotor 30, the front plate 40 and the rear plate 50 when the operational fluid is supplied to the delay chambers R2 and is discharged from the advance chambers R1. The relative rotation of the internal rotor 20 and the vanes 60 is also limited by the upper left vane 60*a* and the radial projection 31*a* as shown in FIG. 3. A predetermined pressure is applied either to the fitting hole 24 or the ring space 37 of the stepped bore 33 thorough the passages 25 or the passage 34. Due to the applied pressure to the locking pin 81, the locking pin 81 moves toward the spring 82 so that the locking pin 81 disengages from the fitting hole 24. In addition, the operational fluid is also supplied to the ring space 38 of the stepped bore 36 from the adjacent delay chamber R2 via the communication passage 35 except at the most advanced position. Due to the applied pressures to the ratchet pin 91, the ratchet pin 91 moves toward the spring 92 so that the ratchet pin 91 disengages from the connecting grooves 27*a*though 27*c*.

In the above embodiment, the stepped bore 33 is coaxial to the fitting hole 24 while the vanes 60 are at the middle of the pressure chamber R0 as shown in FIG. 2. At this position, the valve timing is set for optimal starting of the internal combustion engine. Therefore, the valve timing may be further delayed up to the maximum delayed position as shown in FIG. 3. Thus, for the high-speed operation of the internal combustion engine, the control valve 100 is controlled to further delay the valve timing. The volumetric efficiency can be improved by the inertia of the air intake under high-speed operation of the internal combustion engine so that higher output can he obtained.

When the internal combustion engine is stalled, the oil pump P is no longer driven by the internal combustion engine so that the pressure chamber R0 no longer receives the operational fluid. At this time, neither the pressure in tile advance chamber R1 nor the pressure in the delay chambers R2 is applied to the vanes 60, but only the rotational counter force is applied to the vanes 60 toward the most delayed position until the crankshaft 54 of the internal combustion engine is completely stopped. The relative position between the internal rotor 20 and the external rotor 30 is decided according to the relative position therebetween at just before stalling of the internal combustion engine.

At this time, if the stepped bore 33 is coaxial to the fitting hole 24, the small diameter portion of the lock pin 81 is projected in the fitting hole 24 so as to prevent the internal rotor 20 with the vanes 60 and the cam shaft 10 from rotating relative to the external rotor 30.

If the stepped bore 33 is positioned at the advance side from the above coaxial position between the stepped bore 33 and the fitting hole 24, the internal rotor 20 with the vanes 60 and the cam shaft 10 is rotated toward the most delayed position by the above counter force. In the rotation of the internal rotor 20, the connecting portion 91*a* of the ratchet pin 91 project in the connecting groove 27*c* by the spring 92 so as to prevent the internal rotor 20 from rotating relative to the external rotor 30. Therefore, the small diameter portion of the lock pin 81 can be projected in the fitting hole 24.

If the stepped bore 33 is positioned at the delay side from the above coaxial position between the stepped bore 33 and the fitting hole 24, for example at the most delayed position as shown in FIG. 3, the internal rotor 20 with the vanes 60 and the cam shaft 10 starts to rotate relative to the external rotor 30 to the advanced direction by a torque variation which is due to the action upon the cam shaft 10 at the cranking of the internal combustion engine. The rotation makes the connecting portion 91*a* of the ratchet pin 91 is projected in the connecting groove 27*c* by the spring 92 as to prevent the internal rotor 20 rotating relative to the external rotor 30. Therefore, the small diameter portion of the lock pin 81 can be projected in the fitting hole 24.

Therefore, despite the large torque variation, the camshaft 10 and the internal rotor 20 rotate integrally with the external rotor 30 during cranking of the internal combustion engine. The vanes cannot generate any undesirable noise since the vanes 60 are held at the middle of the pressure chamber R0 when the stepped bore 33 becomes coaxial to the fitting hole 24.

According to the first embodiment of the present invention, no undesirable noise shall be generated at all while the internal combustion engine is cranking. Further, volumetric efficiency may be improved by delaying closure of an air-intake valve.

In the above embodiment, the ring space 38 of the stepped bore 36 communicates with the adjacent delay chamber R2. However, this invention may be adapted to another type of the valve timing control device. For example, the ring space 38 of the stepped bore 36 communicates with the adjacent advance chamber R1. Further, in the above embodiment, the cam shaft 10 drives the air intake valves of the internal combustion engine. However, this invention may adapt to another cam shaft that drives the exhaust valves of the internal combustion engine.

What is claimed is:

1. A valve timing control device comprising:

a rotary shaft rotatably assembled within a cylinder head of an internal combustion engine;

a rotational transmitting member mounted around the peripheral surface of the rotary shaft so as to rotate relative thereto within a predetermined range for transmitting a rotational power from a crank shaft;

a vane provided on either one of the rotary shaft and the rotational transmitting member;

a pressure chamber formed between the rotary shaft and the rotational transmitting member, and divided into an advance chamber and a delay chamber by the vane;

a first fluid passage for supplying and discharging a fluid to and from the advance chamber;

a second fluid passage for supplying and discharging a fluid to and from the delay chamber;

a locking mechanism for holding the vane in the middle position of the pressure chamber, when the internal combustion engine starts; and a control mechanism for restricting the rotational transmitting member to rotate around the rotary shaft, when the vane is in the middle position and a pressure of either one of the advancing chamber and the delaying chamber is less than a predetermined pressure.

2. A valve timing control device according to claim 1, wherein the control mechanism includes:

a ratchet pin;

a refuge hole formed in one of the rotational transmitting member and the rotary shaft for accommodating therein the ratchet pin spring-biased toward the other of the rotary shaft and the rotational transmitting member; and a first hole formed in the other of the rotary shaft and the rotational transmitting member for fitting therein a top portion of the ratchet pin when the vane is in the middle position of the pressure chamber.

3. A valve timing control device according to claim 2, wherein the control mechanism further includes a third fluid passage communicating the refuge hole with the pressure chamber such that the ratchet pin is kept in the refuge hole.

4. A valve timing control device according to claim 2, wherein the control mechanism further includes a second hole formed in the other of the rotary shaft and the rotational transmitting member for fitting therein the top portion of the ratchet pin, wherein the first hole and the second hole are arranged adjacent to each other.

5. A valve timing control device according to claim 4, wherein the top portion of the ratchet pin can move from the second hole to the first hole.

6. A valve timing control device according to claim 5, wherein the second hole is position more advance than the first hole in the rotational direction of the rotary shaft and the rotational transmitting member.

* * * * *